US007695116B2

(12) United States Patent
Fukuyama

(10) Patent No.: US 7,695,116 B2
(45) Date of Patent: Apr. 13, 2010

(54) LIQUID DROPLET DISCHARGING DEVICE AND IMAGE FORMING APPARATUS

(75) Inventor: Kiyoaki Fukuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 595 days.

(21) Appl. No.: 11/605,003

(22) Filed: Nov. 28, 2006

(65) Prior Publication Data

US 2007/0125875 A1 Jun. 7, 2007

(30) Foreign Application Priority Data

Dec. 1, 2005 (JP) ..... 2005-347658

(51) Int. Cl.
*B41J 2/045* (2006.01)

(52) U.S. Cl. ..... 347/70

(58) Field of Classification Search ..... 347/68–72
See application file for complete search history.

(56) References Cited

U.S. PATENT DOCUMENTS

| | | | | |
|---|---|---|---|---|
| 6,109,737 | A * | 8/2000 | Kishima | 347/70 |
| 2004/0119780 | A1 * | 6/2004 | Usui et al. | 347/40 |
| 2005/0231575 | A1 | 10/2005 | Bannai et al. | |
| 2006/0007272 | A1 | 1/2006 | Ogata et al. | |

FOREIGN PATENT DOCUMENTS

| | | | |
|---|---|---|---|
| EP | 0830945 | A1 | 3/1998 |
| JP | 10-100401 | | 4/1998 |
| JP | 2854876 | | 11/1998 |
| JP | 3147132 | | 1/2001 |
| JP | 2003-19794 | | 1/2003 |
| JP | 2004-98310 | | 4/2004 |
| WO | WO2004/085161 | A1 | 10/2004 |
| WO | WO2005/000976 | A1 | 1/2005 |

OTHER PUBLICATIONS

Oct. 16, 2007 European Search Report in connection with corresponding European patent application No. EP 06 25 6135.

* cited by examiner

*Primary Examiner*—Stephen D Meier
*Assistant Examiner*—Geoffrey Mruk
(74) *Attorney, Agent, or Firm*—Cooper & Dunham LLP

(57) ABSTRACT

In a disclosed recording head, a piezoelectric element applies pressure to a liquid chamber by causing an oscillating plate of the liquid chamber to be displaced. Liquid is supplied to the liquid chamber via a flow resistance part. The oscillating plate has a first portion facing a liquid chamber and a second portion facing the liquid supplying path. The piezoelectric element is longer than the liquid chamber, and an edge of the piezoelectric element on the flow resistance part side is positioned not to face the second portion of the oscillating plate but to face the first portion of the oscillating plate.

9 Claims, 14 Drawing Sheets

LIQUID DROPLET DISCHARGING DEVICE AND IMAGE FORMING APPARATUS

BACKGROUND

1. Technical Field

This disclosure relates to liquid droplet discharging devices and image forming apparatuses using the same for ejecting liquid droplets, and more particularly to a liquid droplet discharging device and an image forming apparatus using the same in which liquid droplet ejection performance is improved.

2. Description of the Related Art

Recording heads are used in inkjet recording devices functioning as image forming apparatuses such as printers, facsimile machines, copiers, and plotters. A recording head typically includes a nozzle for discharging ink droplets (recording liquid), a liquid chamber (also referred to as a pressure chamber, a pressurized liquid chamber, a discharge chamber, an ink chamber, an ink flow path, etc.) with which the nozzle is in communication, and an actuator for generating energy to apply pressure to ink inside the liquid chamber. By driving the actuator, ink inside the liquid chamber is pressurized so that ink droplets are discharged from the nozzle to record an image. The mainstream method is an ink-on-demand method performed by discharging ink droplets only when it is necessary to record an image.

Recording heads can be categorized according to various methods depending on the type of actuator used for discharging ink droplets. For example, Patent Document 1 discloses the following known methods. In a piezo method, one of the walls of a liquid chamber is a thin oscillating plate. A piezoelectric element is provided corresponding to the oscillating plate, which piezoelectric element functions as an electromechanical transducer. The piezoelectric element deforms as voltage is applied, which causes the oscillating plate to deform, thereby changing the pressure in the liquid chamber. The change of pressure in the liquid chamber causes ink droplets to be ejected. In a bubble jet method (registered trademark), a heating element is provided inside a liquid chamber. The heating element emits heat when a current is received, and the heat generates bubbles. Pressure due to the bubbles causes ink droplets to be ejected. Patent document 2 discloses an electrostatic type. Specifically, one of the walls of a liquid chamber is an oscillating plate. An individual electrode is provided outside the liquid chamber, facing the oscillating plate. An electric field is applied between the oscillating plate and the electrode, which generates an electrostatic force. The electrostatic force causes the oscillating plate to deform, which changes the internal pressure and the volume of the liquid chamber, so that ink droplets are ejected from a nozzle.

There is also a method employing a piezoelectric element as pressure generating means. As described in examples disclosed in Patent Documents 3 and 4, this method typically employs an oscillating plate provided with an island-shaped or stripe-shaped thick part where the oscillating plate engages with the piezoelectric element. By providing the thick part in the oscillating plate, the engagement with the piezoelectric element is facilitated. This prevents adhesives from sticking out and the engagement position from being displaced, which cause inconsistencies in the discharge volume. Accordingly, the ejected ink droplets are evenly formed.

It is necessary to ensure that the displacement of the piezoelectric element is only communicated inside of the liquid chamber. Problems are created if the piezoelectric element directly pushes up parts other than the liquid chamber such as a flow path unit including the oscillating plate or a flow path plate. Specifically, the pressure inside the liquid chamber does not increase and oscillation of the flow path unit is propagated to other units, which causes mutual interference and a significantly adverse effect on steadiness of ejection. Therefore, the piezoelectric element is generally smaller than the liquid chamber and provided inside the liquid chamber.

Patent Document 1: Japanese Laid-Open Patent Application No. H10-100401

Patent Document 2: Japanese Laid-Open Patent Application No. H2-289351

Patent Document 3: Japanese Patent No. 3147132

Patent Document 4: Japanese Laid-Open Patent Application No. 2003-19794

There are requirements for inkjet recording devices to produce high quality images. To meet these requirements, liquid chambers are reduced in size, so that smaller ink droplets can be ejected. Further, to make nozzles eject ink droplets by a finer pitch, liquid chambers are not only reduced in width but also in length. This increases the pressure resonant frequency of the liquid chamber, so that smaller ink droplets are ejected.

However, even if the liquid chamber is reduced in length, it is not possible to simply shorten the piezoelectric element. FIG. 13 is a schematic diagram for describing displacement of a driving unit of a conventional piezoelectric element 500. Displacement of the laminated-type piezoelectric element 500 occurs in a d33 direction, which is the thickness direction. The piezoelectric element 500 is shortened in the longitudinal direction of a liquid chamber, and the entire bottom surface of the piezoelectric element 500 is bonded and fixed to a base 600. Therefore, displacement of the piezoelectric element 500 is obstructed due to inert parts on both edges. Also, an active part of the piezoelectric element 500 is partly obstructed from being displaced in the thickness direction, which active part is supposed to cause displacement of a thick part 420 of an oscillating plate. When the piezoelectric element is shortened, the areas of the inert parts that obstruct displacement are unchanged, while the active part that becomes displaced in the thickness direction is shortened. Therefore, a predetermined amount of displacement cannot be achieved, and conversion efficiency is significantly degraded. Accordingly, the piezoelectric element 500 cannot be made compact in accordance with the size of a liquid chamber 210, as shown in a partial cut-away view of FIG. 14. Even if the liquid chamber 210 is reduced in size, the size of the piezoelectric element 500 cannot be changed much. Thus, if an oscillating plate 400 only contacts the piezoelectric element 500 at a thick part 420, a large area of a diaphragm part (thin layer part) 410 on the side of a flow resistance part 220 does not receive the effects of the piezoelectric element 500. As a result, compliance (reduced restriction) at the flow resistance part 220 becomes excessively large, such that preferable ejecting properties cannot be achieved.

BRIEF SUMMARY

In an aspect of this disclosure, there is provided a liquid droplet discharging device and an image forming apparatus using the same in which liquid droplet ejecting performance is improved and high quality images can be formed.

In another aspect of this disclosure, there is provided a liquid droplet discharging device including a nozzle plate including a nozzle configured to discharge a liquid droplet; a liquid chamber corresponding to the nozzle; a liquid supplying path configured to supply liquid to the liquid chamber; an oscillating plate having a first portion facing the liquid chamber and a second portion facing the liquid supplying path; and a pressure generating unit configured to apply pressure to the liquid in the liquid chamber by causing the oscillating plate to be displaced, the pressure generating unit being fixed to a fixing base; wherein the pressure generating unit is longer than the liquid chamber in a longitudinal direction of the liquid chamber, and an edge of the pressure generating unit near the liquid supplying path is positioned not to face the second portion of the oscillating plate but to face the first portion of the oscillating plate.

An image forming apparatus including the above-mentioned liquid droplet discharging device can also be provided, wherein the image forming apparatus is configured to form an image with the liquid droplet discharged from the nozzle of the liquid droplet discharging device.

In an embodiment of the present invention, a liquid droplet discharging device and an image forming apparatus using the same can be provided, in which liquid droplet ejecting performance is improved and high quality images can be formed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
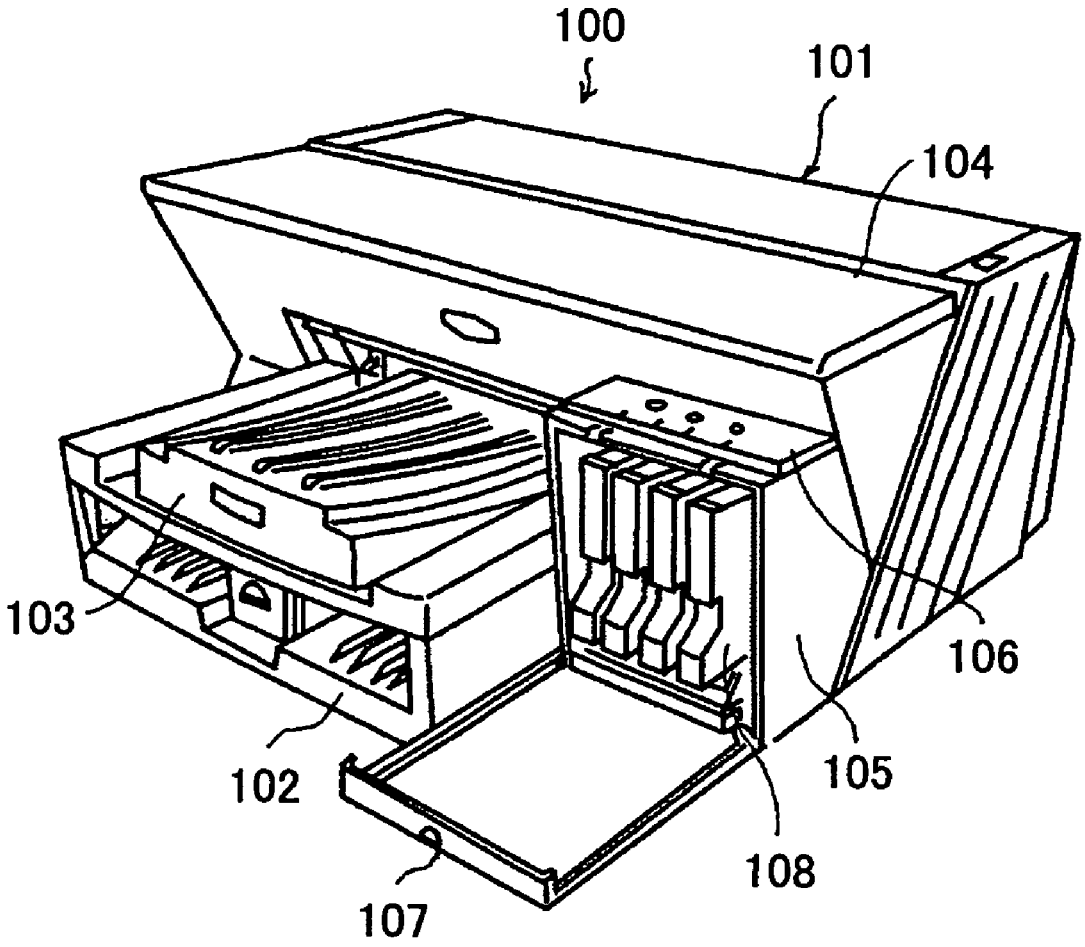
FIG. 1 is a perspective front view of an image forming apparatus according to an embodiment of the present invention.

FIG. 1 is a perspective front view of an image forming apparatus 100 according to an embodiment of the present invention. The image forming apparatus 100 includes an apparatus body 101, a paper feeding tray 102 inserted in the apparatus body 101 for storing recording paper, and a paper discharge tray 103 inserted in the apparatus body 101 for stacking recording paper on which images are recorded (formed). At the top of the apparatus body 101 is provided a top cover 104 that can be opened/closed. On one edge on the front of the apparatus body 101, there is provided a cartridge loading unit 105 protruding out to the front and positioned below the top cover 104. On top of the loading unit 105 is provided an operations unit 106 including operation keys and a display device. The loading unit 105 has a front cover 107 that can be opened/closed. The front cover 107 is opened to attach/detach ink cartridges 108, serving as liquid replenishing means.

Figure 2:
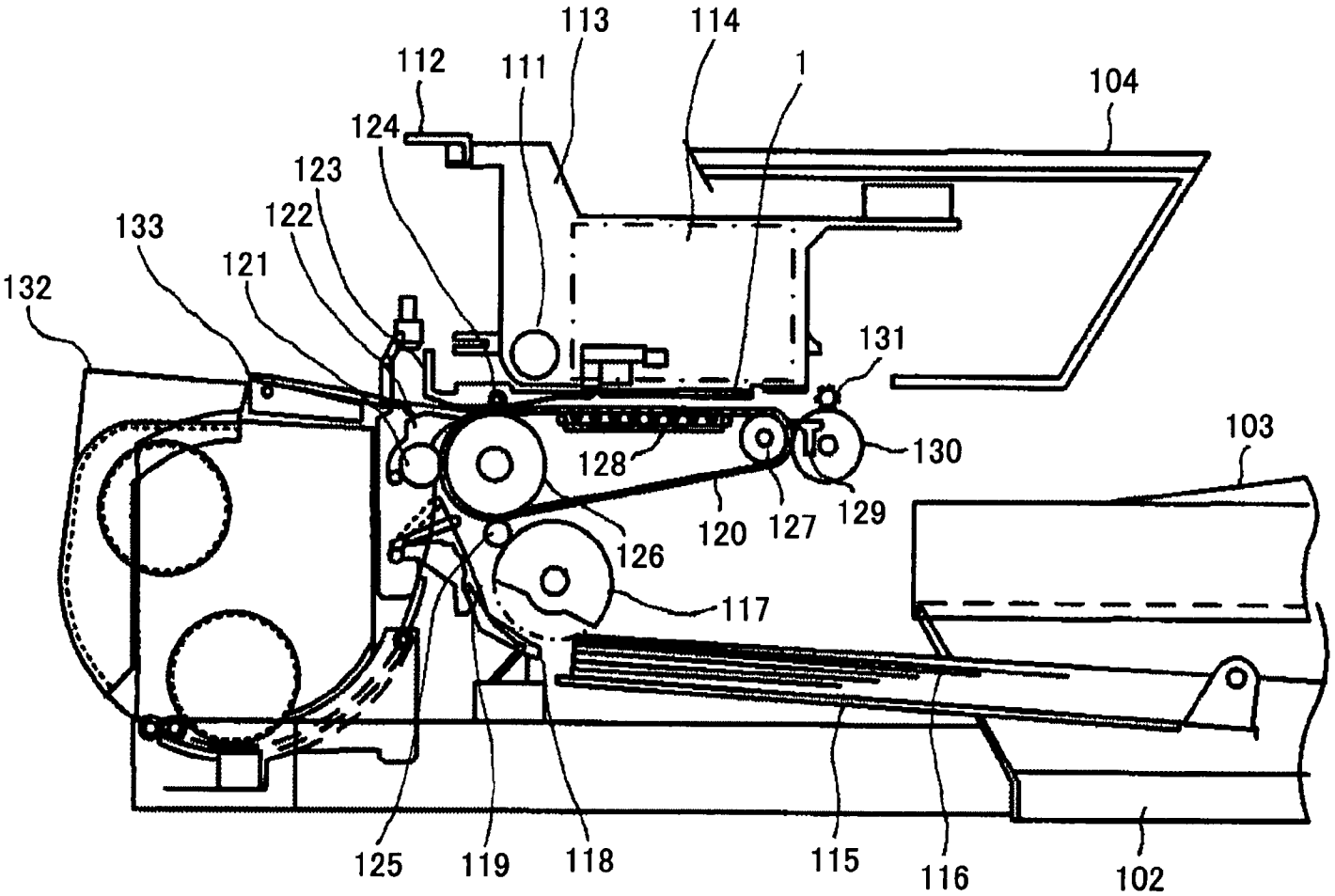
FIG. 2 is a cut-away side view of a mechanical part of the image forming apparatus shown in FIG. 1.
Figure 3:
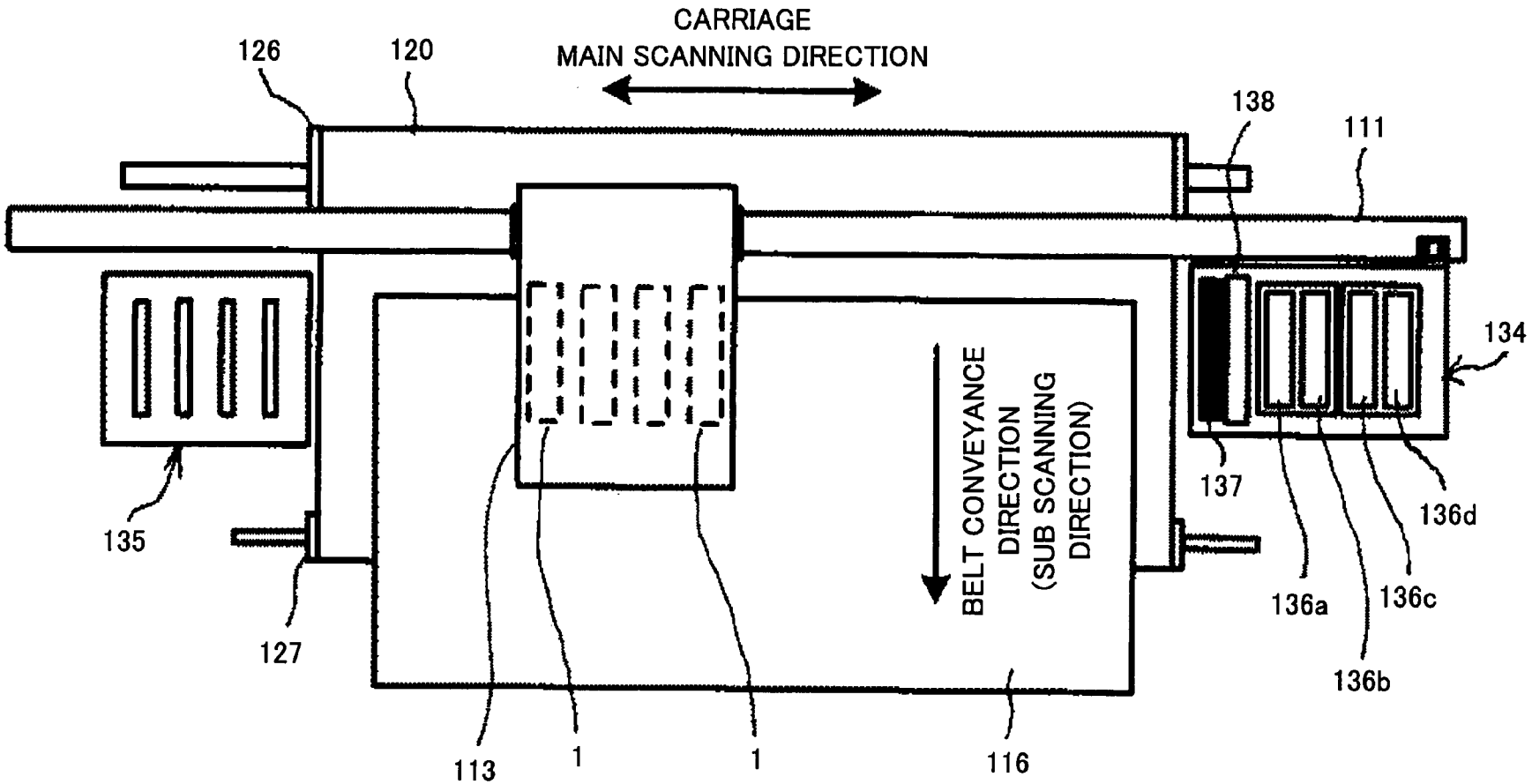
FIG. 3 is a plan view of the mechanical part of the image forming apparatus shown in FIG. 1.

FIG. 2 is a cut-away side view of a mechanical part of the image forming apparatus 100, and FIG. 3 is a plan view of the mechanical part of the image forming apparatus 100. A carriage 113 is held by a guide rod 111 serving as a guide member laterally provided on a side plate of the apparatus body 101 and a stay 112, so that the carriage 113 is slidable in a main scanning direction. A main scanning motor (not shown) moves the carriage 113 in the main scanning direction. The carriage 113 includes recording heads 1, which are four ink jet heads for ejecting ink droplets of yellow (Y), cyan (C), magenta (M), and black (Bk). The recording heads 1 are arranged in a direction such that plural ink ejecting outlets intersect the main scanning direction and ink droplets are ejected downward.

The carriage 113 includes sub tanks 114, which are liquid containers for supplying ink of each color to the recording heads 1. Ink is replenished in the sub tanks 114 from the ink cartridges 108 of corresponding colors through ink supplying tubes. The ink cartridges 108 contain ink of yellow (Y), cyan (C), magenta (M), and black (Bk). The sub tanks 114 for supplying ink to the recording heads 1 and the ink cartridges 108 for replenishing ink in the sub tanks 114 configure a recording liquid supplying device.

A paper feeding unit is provided for feeding sheets of recording paper 116 stacked on a sheet stacking unit (thick plate) 115 of the paper feeding tray 102. The paper feeding unit includes a semicircular roller (paper feeding roller) 117 that separates one sheet at a time from the recording paper 116 stacked on the sheet stacking unit 115 and conveys the sheet, and a separating pad 118 made of a material having a large friction coefficient, which is pressed against the semicircular roller 117.

A conveying unit conveys the recording paper 116 from the paper feeding tray 102 from a guide 119 to a position below the recording heads 1. The conveying unit includes a conveying belt 120, a counter roller 121, a conveying guide 122, a pressing member 123, and a tip pressurizing roller 124. The recording paper 116 is adhered to the conveying belt 120 by static electricity, and is conveyed by the conveying belt 120. The recording paper 116 conveyed from the paper feeding unit via the guide 119 is sandwiched between the counter roller 121 and the conveying belt 120. The recording paper 116 is conveyed upward in a substantially vertical direction by the counter roller 121 and the conveying belt 120, and the conveying guide 122 changes the direction of the recording paper 116 by substantially 90 degrees onto the conveying belt 120. The pressing member 123 presses the tip pressurizing roller 124 against the conveying belt 120. Further, a charging roller 125 is provided as charging means for charging the surface of the conveying belt 120. The conveying belt 120 is an endless belt stretched around a conveying roller 126 and a tension roller 127. As shown in FIG. 3, the conveying belt 120 revolves in a belt conveying direction. The charging roller 125 contacts the surface layer of the conveying belt 120, and is rotated by the movement of the conveying belt 120.

On the backside of the conveying belt 120, a guide member 128 is arranged corresponding to an imaging area where the recording heads 1 perform recording. The top surface of the guide member 128 protrudes more toward the recording heads 1 than the tangent line of the conveying roller 126 and the tension roller 127 supporting the conveying belt 120. Thus, in the imaging area, the conveying belt 120 is pushed up and guided by the top surface of the guide member 128, so that planarity is maintained highly precisely.

A paper discharge unit is provided for discharging the recording paper 116 onto which images are recorded by the recording heads 1. The paper discharge unit includes a separating claw 129 for separating the recording paper 116 from the conveying belt 120 and paper discharge rollers 130, 131. The paper discharge tray 103 is provided below the paper discharge roller 130. The height from the position between the paper discharge rollers 130, 131 and the paper discharge tray 103 is high enough to stack a certain number of sheets of the recording paper 116.

A double-side paper feeding unit 132 is detachably attached to the backside of the apparatus body 101. The conveying belt 120 revolves in an opposite direction to feed the recording paper 116 to the double-side paper feeding unit 132. The double-side paper feeding unit 132 reverses the recording paper 116 and feeds it back in between a counter roller 133 and the conveying belt 120. A bypass tray 133 is provided on the top surface of the double-side paper feeding unit 132.

As shown in FIG. 3, in a non-imaging area on one side of the carriage 113 in a main scanning direction, there is provided a maintaining/recovering mechanism 134 functioning as reliability maintaining means for maintaining and restoring conditions of the nozzles of the recording heads 1. In the non-imaging area on the other side of the carriage 113, there is provided a blank ejection receiving member 135. The maintaining/recovering mechanism 134 includes four cap members 136 functioning as capping means for capping the nozzle surfaces of the recording heads 1, a wiper blade 137 functioning as wiping means for wiping the nozzle surfaces, and a blank ejection receiver 138.

Figure 4:
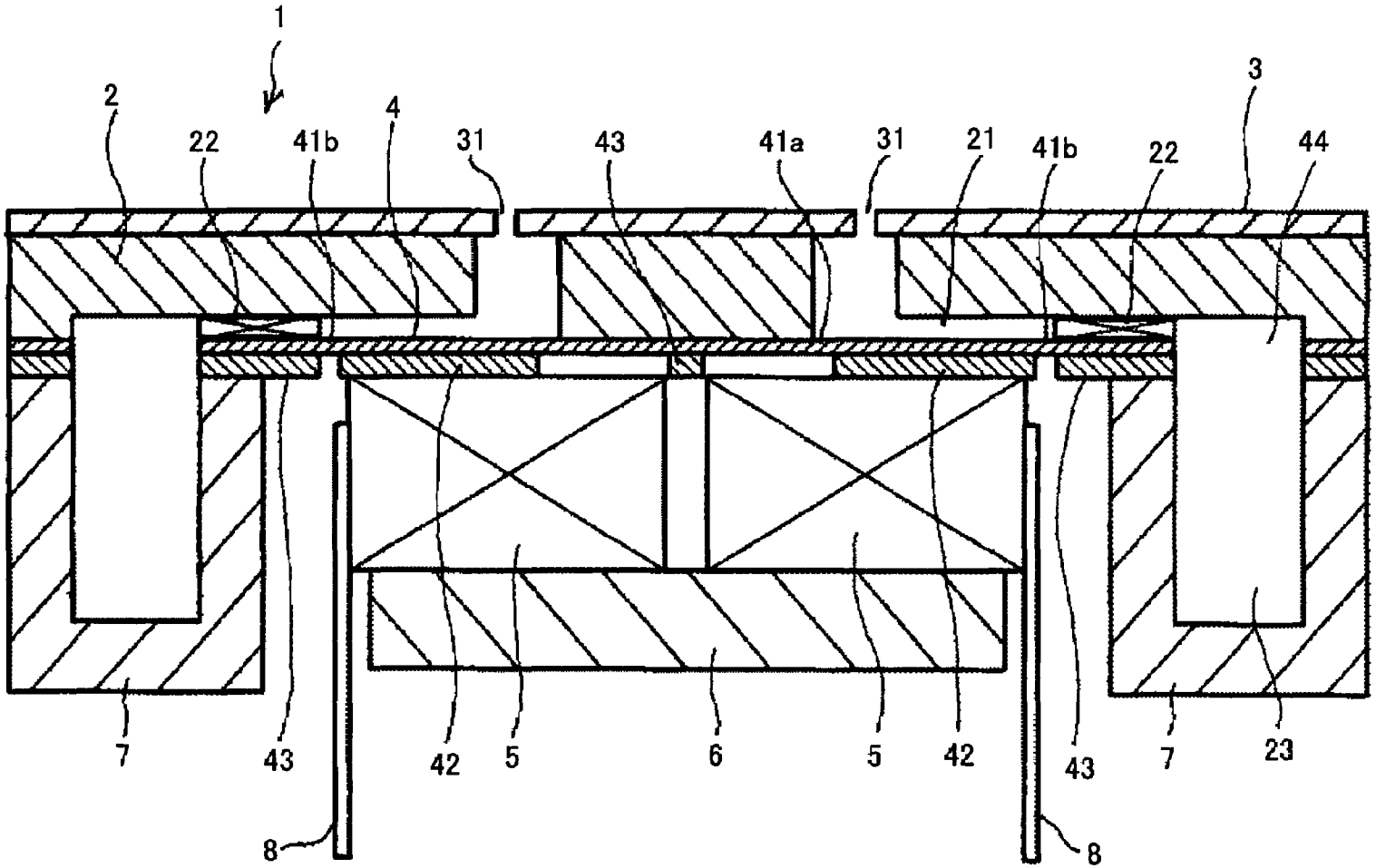
FIG. 4 is a partial cut-away view of a recording head along a longitudinal direction of a liquid chamber.
Figure 5:
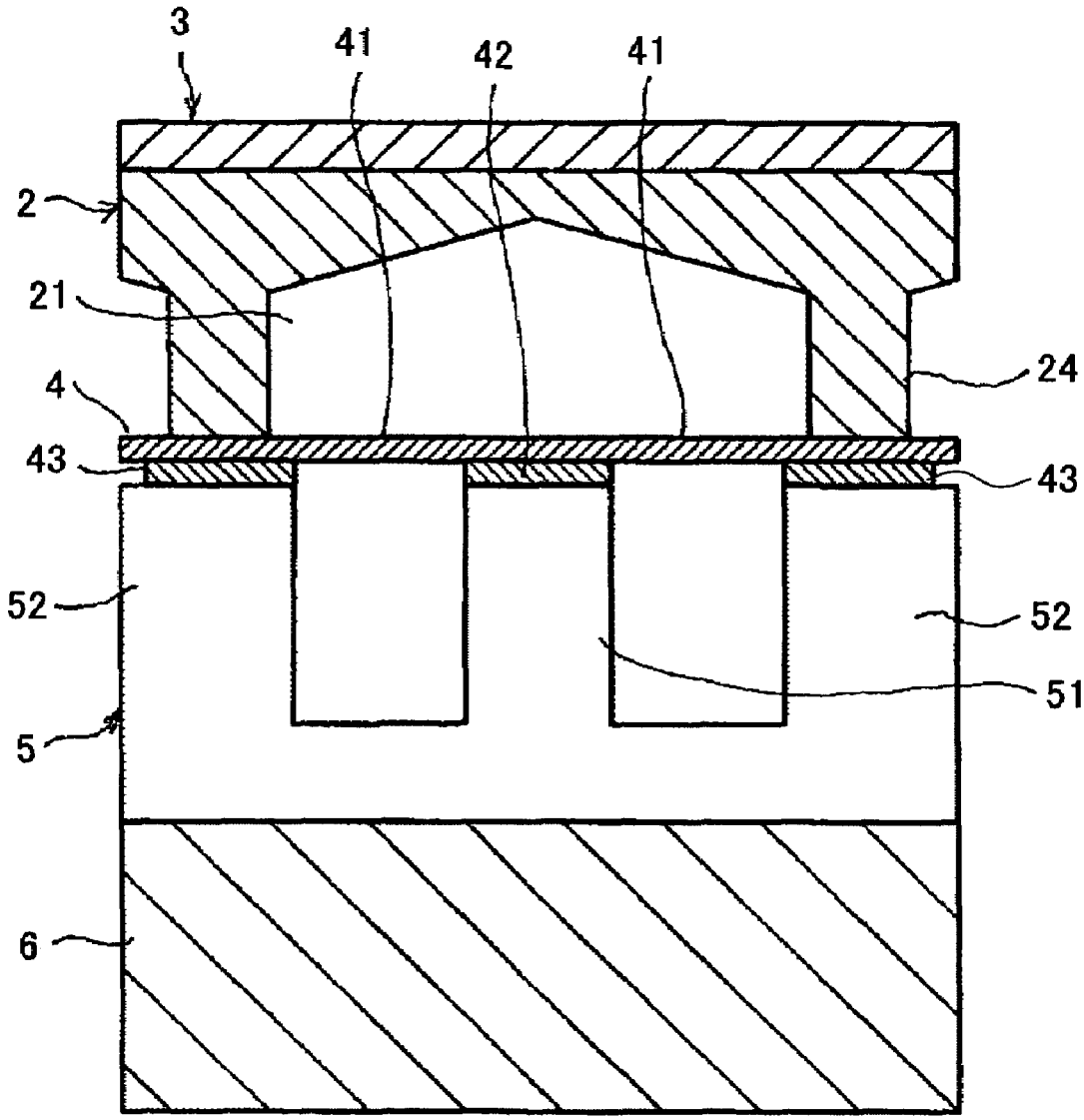
FIG. 5 is a partial cut-away view of the recording head along a latitudinal direction of the liquid chamber.
Figure 6:
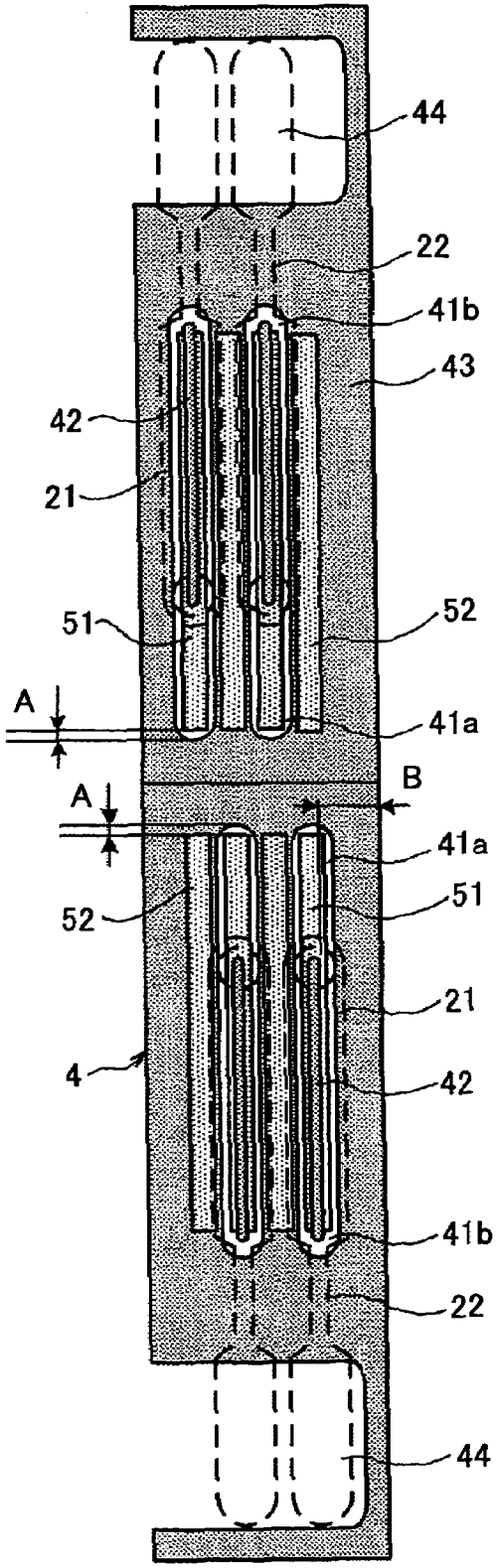
FIG. 6 is a plan view of a layout of an oscillating plate and a flow path.
Figure 7:
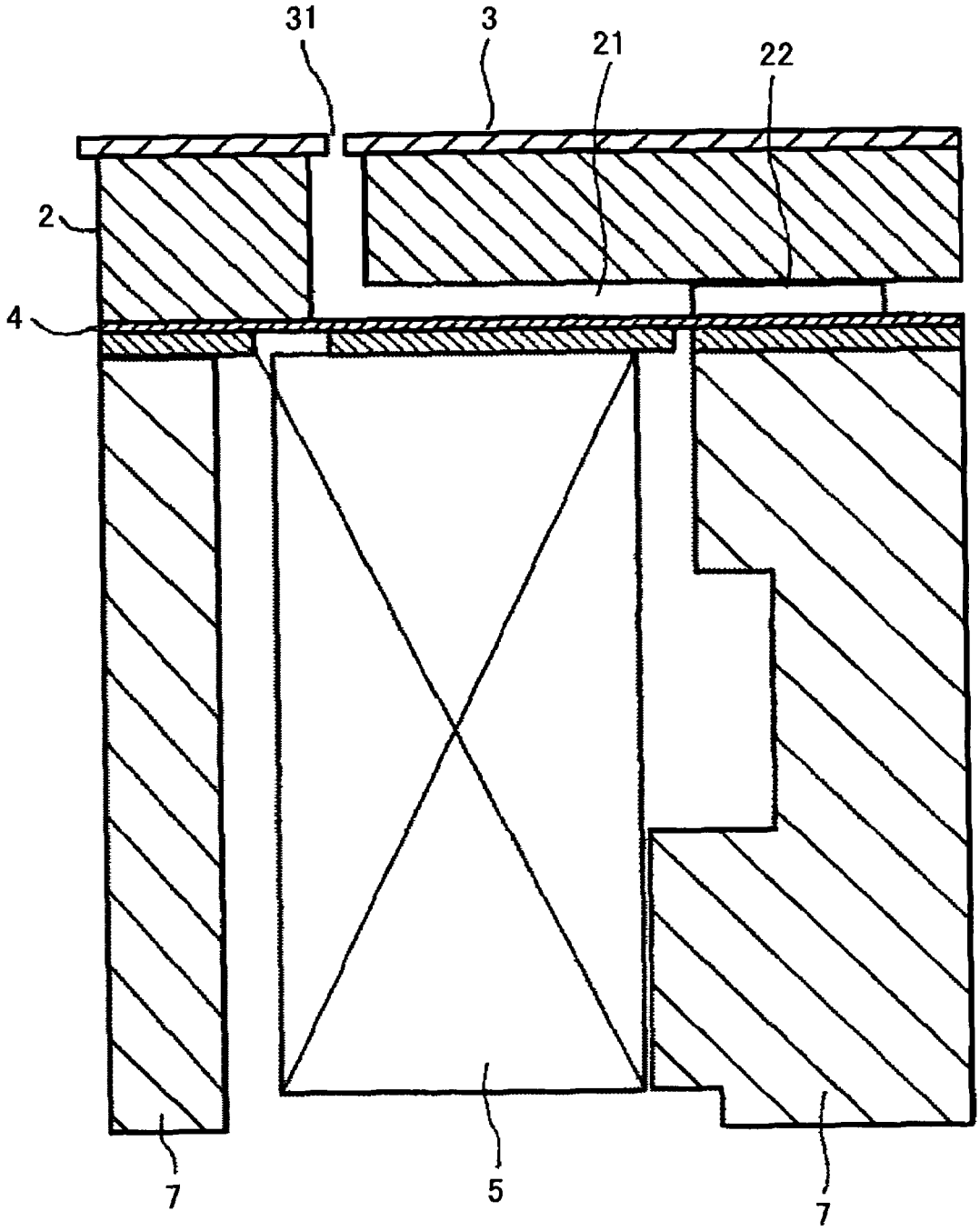
FIG. 7 is a partial cut-away view of another example of a recording head along a longitudinal direction of a liquid chamber.

FIG. 4 is a partial cut-away view of the recording head 1 along a longitudinal direction of a liquid chamber 21, FIG. 5 is a partial cut-away view of the recording head 1 along a latitudinal direction of the liquid chamber 21, and FIG. 6 is a plan view of a layout of an oscillating plate 4 and a flow path. Each of the recoding heads 1 includes a flow path plate 2 forming the liquid chamber 21 and a flow resistance part 22; a nozzle plate 3 bonded to the top surface of the flow path plate 2 and forming nozzles 31 for ejecting ink droplets; the oscillating plate 4 bonded to the bottom surface of the flow path plate 2 and forming a diaphragm part (thin part) 41, island-shaped protruding parts (island parts) 42, frame-shaped thick parts 43 on the periphery of the island-shaped protruding parts (island parts) 42, and an ink flow inlet 44; laminated piezoelectric elements 5 formed by alternately laminating a piezoelectric material and an internal electrode, the piezoelectric elements 5 being bonded to the oscillating plate 4 via not-shown bonding layer; a base 6 on which the piezoelectric elements 5 are fixed; and a frame 7. Referring to FIG. 4, a piezoelectric direction of the piezoelectric elements 5 is a d33 direction, i.e., displacement of the piezoelectric elements 5 occurs in the thickness direction. This displacement applies pressure to ink inside the liquid chamber 21. However, as shown in FIG. 7, the piezoelectric direction of the piezoelectric elements 5 can be in a d31 direction, and displacement in this direction can also apply pressure to ink inside the liquid chamber 21.

As shown in the cut-away view of FIG. 5, the piezoelectric element 5 is divided in a comb-like manner by a half-cut dicing process, and the comb teeth are alternately used as a driving part 51 and supporting parts 52 (non-driving part). This structure is referred to as a bi-pitch structure. Electric wires 8, which supply driving voltage to the piezoelectric element 5, are connected from the flow resistance part 22 side.

Figure 8:
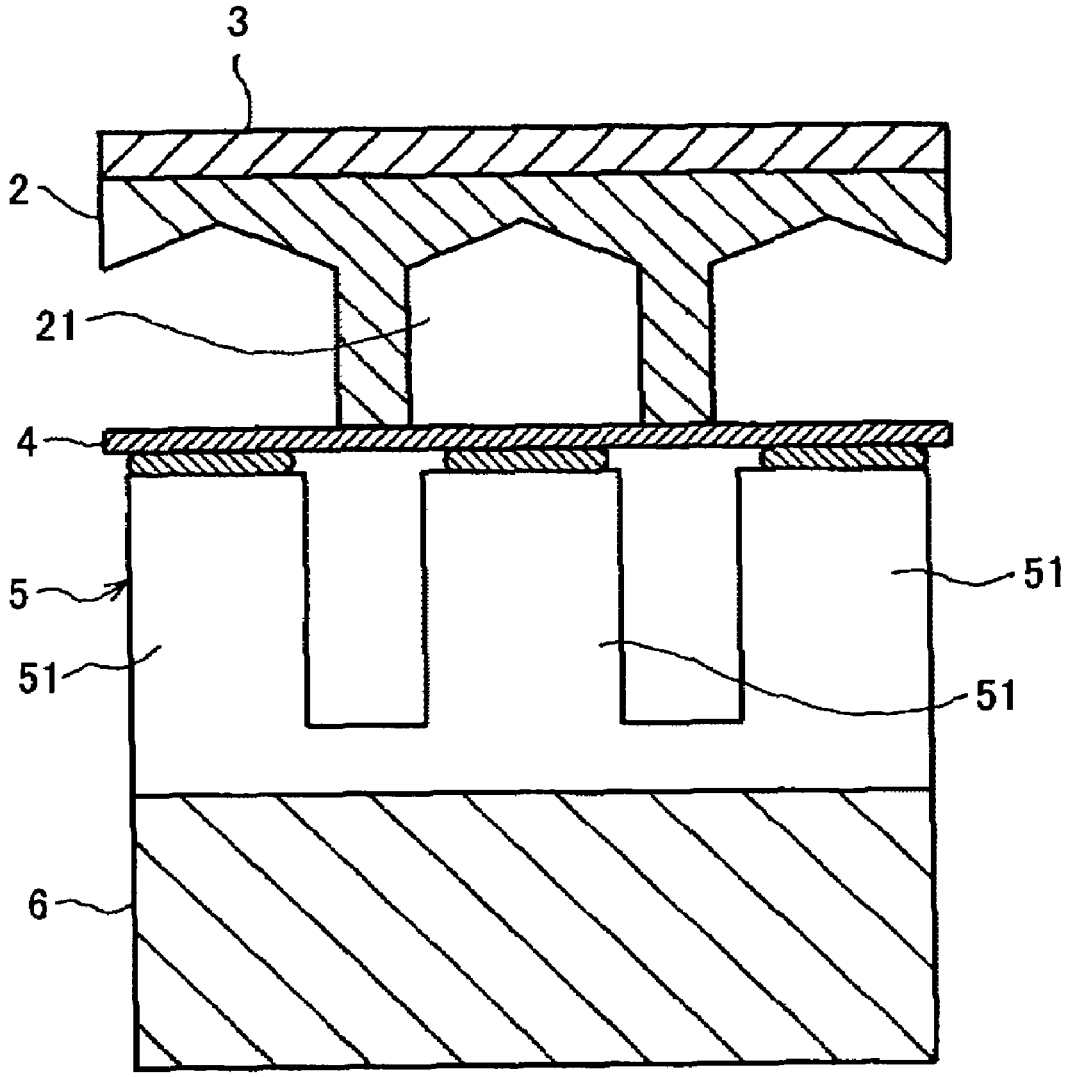
FIG. 8 is a partial cut-away view of still another example of a recording head along a latitudinal direction of the liquid chamber.

The flow path plate 2 can be a thin plate made of, e.g., SUS304. The flow path plate 2 is cut out to form the liquid chamber 21 and the flow resistance part 22, path-through slots are formed at positions corresponding to the nozzles 31 by press-patterning, and flow path partition walls 24 are configured by remaining parts of the flow path plate 2 corresponding to peripheral parts of the liquid chamber 21 and the flow resistance parts 22. Accordingly, as shown in FIG. 5, the supporting parts 52 of the piezoelectric element 5 support the flow path partition walls 24. As the supporting parts 52 of the piezoelectric element 5 support the oscillating plate 4 and the flow path partition walls 24, the flow path plate 2 is prevented from being lifted up due to increased pressure in the liquid chamber 21. Further, the flow path partition walls 24 are prevented from being oscillated due to oscillation of the piezoelectric element 5 applying pressure to the liquid chamber 21. Accordingly, this configuration is highly effective in preventing mutual interference. As shown in a cut-away side view of FIG. 8, a normal pitch structure can be employed, in which the driving parts 51 of the piezoelectric element 5 are provided at the same intervals as the nozzle pitch.

Areas of the flow path plate 2 in contact with ink are preferably coated with a liquid-resistant thin layer made of organic resin such as titanium nitride or polyimide. By forming such a liquid-resistant thin layer, the material of the flow path plate 2 is prevented from being eluted in the ink, and wettability is improved so that bubbles are not retained. Accordingly, ink can be steadily ejected. The flow path plate 2 is cut out to form a compact liquid chamber 21. For example, the liquid chamber 21 has a length of 800 μm and a width of 139 μm, the liquid chamber pitch is 150 dpi, and the width of the flow path partition walls 24 is approximately 30 μm on the surface bonded with the oscillating plate 4. By forming the flow path plate 2 by a press method, a pentagular liquid chamber 21 can be formed, as shown in FIG. 5.

The oscillating plate 4 is formed by laminating two layers of nickel plate by an electroforming method, including the diaphragm part (thin part) 41, the island-shaped protruding parts (island parts) 42 formed in the center of the diaphragm part 41 and bonded to the driving part 51 of the piezoelectric element 5, the frame-shaped thick parts 43 including beams that are bonded with the supporting parts 52, and an opening serving as the ink flow inlet 44.

Figure 9A:
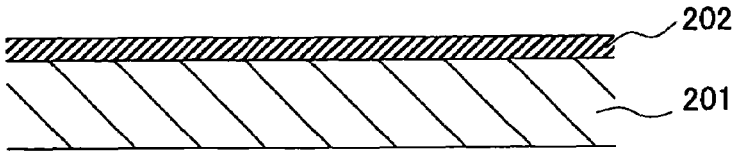
FIGS. 9A through 9F are process diagrams of a method of forming the oscillating plate.
Figure 9B:
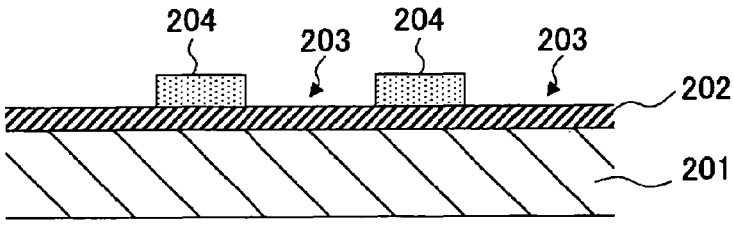
Figure 9C:
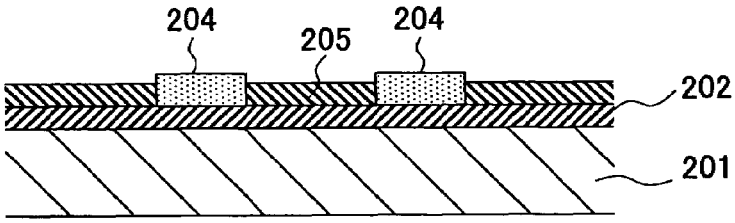
Figure 9D:
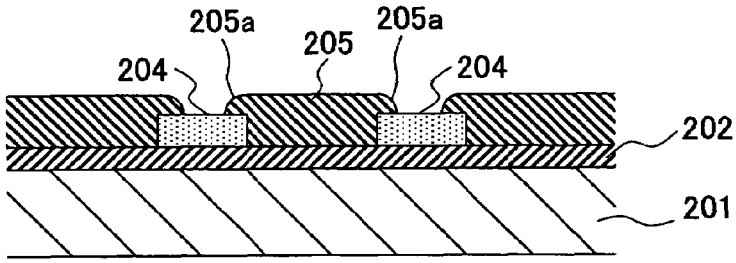
Figure 9E:
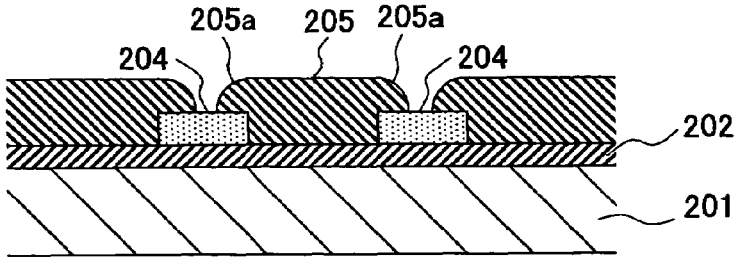
Figure 9F:
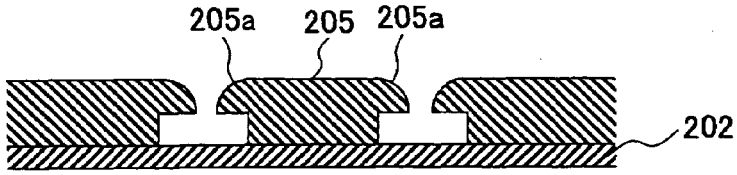

A method of forming the oscillating plate 4 is described with reference to FIGS. 9A through 9F. First, as shown in FIG. 9A, a first layer 202 made of Ni serving as the diaphragm part 41 is formed on an electroformed support substrate 201. Then, as shown in FIG. 9B, resist patterns 204 are formed, thereby forming windows 203 corresponding to parts for the island-shaped protruding parts 42 and the thick parts 43. Subsequently, nickel electroforming is performed. Then, as shown in FIG. 9C, nickel precipitates out and deposits on the first layer 202, thereby forming a nickel layer 205. As nickel electroforming is continued, as shown in FIG. 9D, the nickel layer 205 grows and rises out of the windows 203. The nickel layer 205 grows further onto the surfaces of the resist patterns 204 due to edge effects, thereby creating over-hanging parts 205*a*. As this process is continued, the nickel layer 205 extends in the thickness direction as shown in FIG. 9E. When the thickness of the nickel layer 205 becomes a predetermined size, the nickel electroforming is ended. As shown in FIG. 9F, the resist patterns 204 and the electroformed support substrate 201 are removed, thereby creating the oscillating plate 4 including the diaphragm part 41 corresponding to the first layer 202 and the island-shaped protruding parts 42 and the thick parts 43 corresponding to the nickel layer 205.

The nozzle plate 3 can be a nickel film formed by, for example, an electroforming method. The nozzle plate 3 includes many nozzles 31, which are fine ejection outlets through which ink droplets are spurted out. The shapes inside the nozzles 31 can be, for example, horn-shaped, substantially cylindrical, or substantially truncated cone-shaped, and the diameters of the nozzles 31 are approximately 20 μm through 35 μm at the ink droplet outlet side. The ink ejection surface (nozzle surface side) of the nozzle plate 3 is coated with a water-repellent film having a water-repellent surface, so that the shapes of the ink droplets and spurting properties are stabilized, thereby achieving high-quality images. The type of the water-repellent film is selected based on physical properties of the ink. For example, the water-repellent film can be formed by perfuming a PTFE-Ni eutectoid plating or applying fluororesin by electrodeposition, applying evaporative fluororesin such as pitch fluoride by vapor deposition, or baking after applying a solvent such as silicon resin and fluororesin.

The frame 7 that forms the ink flow inlet 44 to which ink is supplied from outside and a common liquid chamber 23 is made of epoxy resin, polyphenylene sulfide, etc.

In the recording head 1 configured as above, a driving waveform having a pulse voltage of 10 V through 50 V is applied to the driving part 51 of the piezoelectric element 5 in accordance with recording signals. As a result, displacement of the driving part 51 occurs in a lamination direction (toward the liquid chamber 21), so that pressure is applied via the oscillating plate 4 to the ink inside the liquid chamber 21. As the ink pressure increases, ink droplets are ejected from the nozzles 31. When ejection of ink droplets is completed, the ink pressure inside the liquid chamber 21 decreases. Accordingly, negative pressure is generated in the liquid chamber 21 due to the inertia of the ink flow and the discharging process of the driving pulse, so that an ink filling process starts. Specifically, ink supplied from an ink tank flows into the common liquid chamber 23, passes through the ink flow inlet 44 and the flow resistance part 22, and fills the liquid chamber 21. The flow resistance part 22 is effective for attenuating residual pressure and/or oscillation after ink ejection; however, the flow resistance part 22 becomes a resistance to resupplying due to surface tension. By selecting an appropriate flow resistance part 22, attenuation of residual pressure and time required for resupplying ink can be balanced, so that the time until performing the next ink ejection (driving cycle) can be reduced.

In the recording head 1, the liquid chamber 21 can be made compact as shown in FIG. 4. Accordingly, the piezoelectric element 5 in the longitudinal direction of the liquid chamber 21 is longer than the liquid chamber 21. Among the left and right edges of the piezoelectric element 5 as viewed in FIG. 4, the edge of the piezoelectric element 5 near the flow resistance part 22 is referred to as the edge on the flow resistance part 22 side, and the other edge is referred to as the edge on the nozzle 31 side. The edge of the piezoelectric element 5 on the flow resistance part 22 side is positioned not to face the flow resistance part 22 but to face the liquid chamber 21. The other edge of the piezoelectric element 5 on the nozzle 31 side is positioned to face the diaphragm part 41*a* of the oscillating plate 4. Therefore, the piezoelectric element 5 is positioned with respect to the oscillating plate 4 so as not to face the frame-shaped thick parts 43. Further, the piezoelectric element 5 is positioned to contact only the island-shaped protruding parts 42 of the oscillating plate 4 facing the liquid chamber 21, and not to contact the other parts of the oscillating plate 4. Thus, displacement occurring at positions other than the contact area with the island-shaped protruding parts 42 is prevented from being communicated to components other than the liquid chamber 21 (e.g., the oscillating plate 4 and the flow path plate 2 of a flow path unit). Further, the piezoelectric element 5 and the base 6 are bonded together such that the edge of the piezoelectric element 5 on the flow resistance part 22 side sticks out from the edge of the base 6 by a predetermined length. This mitigates the constraint imposed by the base 6 onto the edge of the piezoelectric element 5 on the flow resistance part 22 side.

By arranging the piezoelectric element 5 with respect to the oscillating plate 4 in the above-described manner, it is possible to narrow the diaphragm part 41*b* of the oscillating plate 4 between the island-shaped protruding part 42 facing the liquid chamber 21 and the frame-shaped thick parts 43 facing the flow resistance part 22. This prevents a large compliance (reduced restriction) from developing at the flow resistance part 22 leading to degraded pressure efficiency. Further, a pressure resonance frequency can be a high value, which enhances the driving frequency and advantageously reduces the sizes of the ink droplets.

Figure 10:
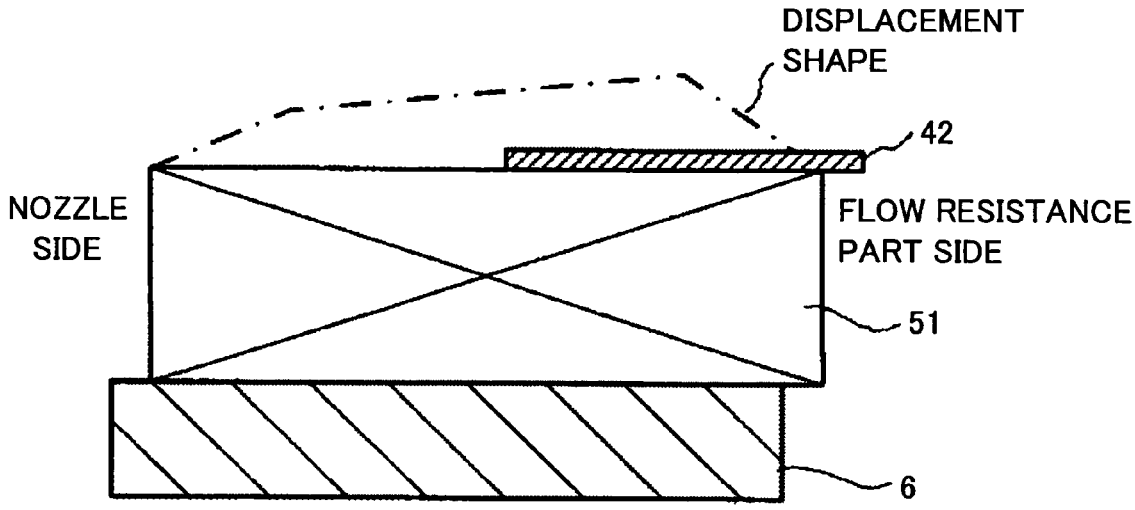
FIG. 10 is a schematic diagram illustrating displacement of a piezoelectric element.

The piezoelectric element 5 and the base 6 are bonded together in such a manner that the constraint imposed by the base 6 onto the edge of the piezoelectric element 5 on the flow resistance part 22 side is mitigated. Therefore, as shown in FIG. 10, displacement of the piezoelectric element 5 is made larger on the flow resistance part 22 side. Accordingly, the displacement of the piezoelectric element 5 can be efficiently communicated to the island-shaped protruding parts 42 of the oscillating plate 4 facing the liquid chamber 21.

In the above-described arrangement of the piezoelectric element 5, the displacement of the piezoelectric element 5 preferably occurs in the d33 direction. As shown in FIG. 7, it is possible to make the displacement occur in the d31 direction, as the piezoelectric direction of the piezoelectric element 5 for applying pressure on ink inside the liquid chamber 21. However, by making the displacement occur in the d33 direction, the amount of displacement is larger and the area of the diaphragm part 41*b* of the oscillating plate 4 is more appropriate. Further, by employing the piezoelectric element 5 in which the displacement occurs in the d33 direction, it is possible to assemble the recording head 1 by laminating the base 6, the piezoelectric element 5, the oscillating plate 4, the flow path plate 2, and the nozzle plate 3. Accordingly, precision in the assembly process can be improved, and yield can be increased.

As shown in FIG. 6, an interval A between the edge of the piezoelectric element 5 on the nozzle 31 side in the longitudinal direction of the liquid chamber 21 and the frame-shaped thick part 43 of the oscillating plate 4 is preferably a predetermined interval such as 50 μm. As the piezoelectric element 5 is fabricated by baking, the size varies by about 50 μm, for example. This interval A is provided to compensate for such inaccuracies in sizes of the piezoelectric element 5 and bonding errors between the piezoelectric element 5 and the island-shaped protruding parts 42 of the oscillating plate 4. Accordingly, the piezoelectric element 5 is prevented from overlapping the frame-shaped thick part 43, thereby increasing yield.

Figure 11:
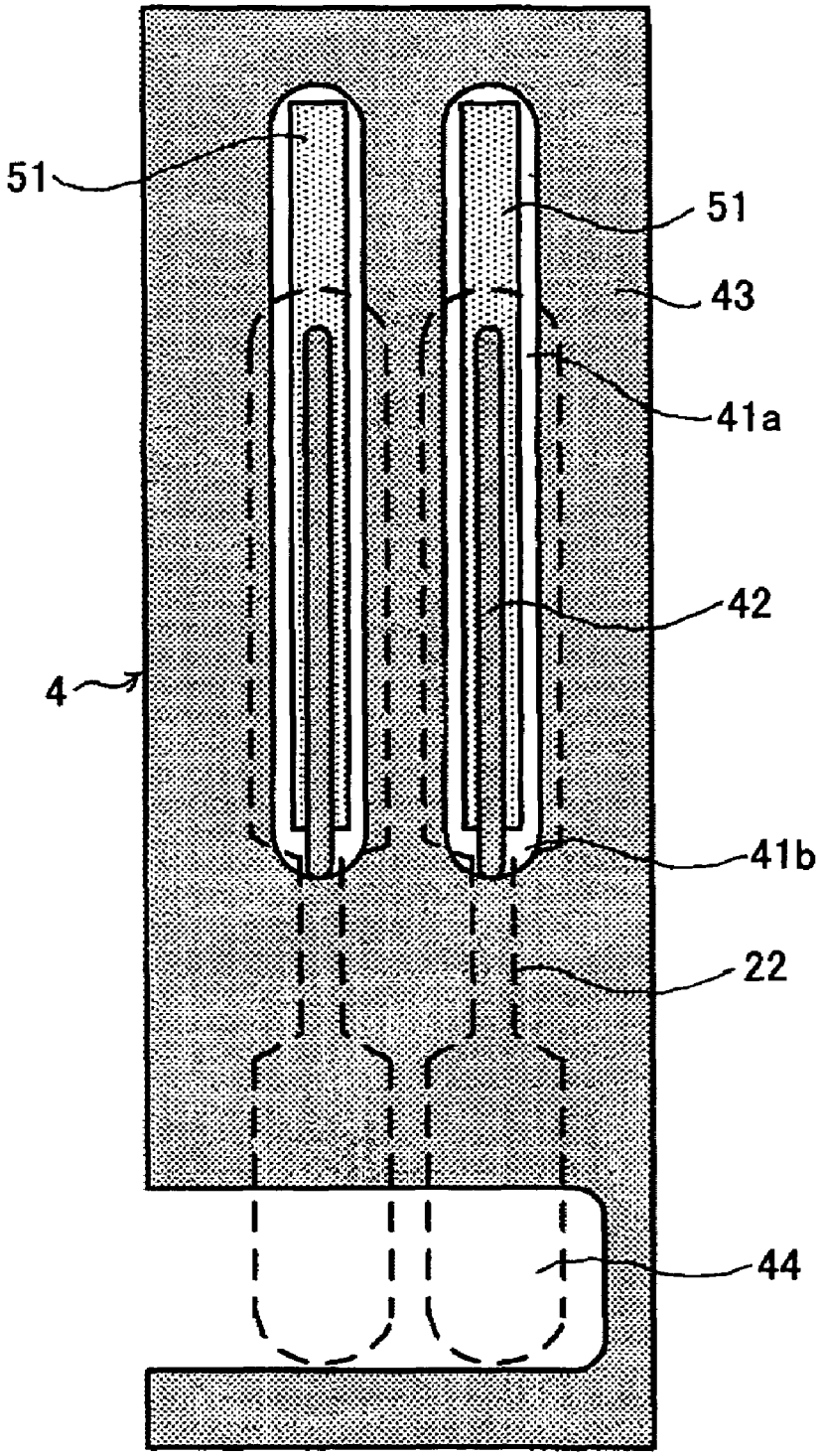
FIG. 11 is a plan view of another example of a layout of the oscillating plate and the flow path.

In the above description, there is the diaphragm part 41*b* between the island-shaped protruding part 42 of the oscillating plate 4 facing the liquid chamber 21 and the frame-shaped thick part 43 facing the flow resistance part 22. However, as shown in FIG. 11, the edge of the island-shaped protruding part 42 facing the liquid chamber 21 on the flow resistance part 22 side can be extended up to the frame-shaped thick part 43. By extending the edge of the island-shaped protruding part 42 on the flow resistance part 22 side up to the frame-shaped thick part 43, displacement of the piezoelectric element 5 can be communicated to the liquid chamber 21 more efficiently. Further, the length and the width of the diaphragm part 41*b* do not need to be prescribed, which increases the yield in fabricating the oscillating plate 4. Moreover, excessive adhesive used when bonding the oscillating plate 4 and the piezoelectric element 5 together escapes from the extended part, so that the adhesive is prevented from flowing to the thin part even when a large amount of adhesive is applied. Therefore, ejection performance is improved, and yield is increased in bonding the oscillating plate 4 and the piezoelectric element 5 together.

In the above description, the oscillating plate 4 is formed by laminating two layers of nickel coating film. However, the diaphragm part 41 can be made of a resin material, and members used as the island-shaped protruding parts 42 and the frame-shaped thick parts 43 can be made of metal. When the diaphragm part 41 is made of a resin material, the rigidity of the diaphragm part 41 can be reduced compared to the case of nickel. Accordingly, the displacement efficiency of the piezoelectric element 5 can be improved. Further, when members used as the island-shaped protruding parts 42 and the frame-shaped thick parts 43 are made of metal, the oscillating plate 4 can be firmly fixed to the flow path partition walls 24 of the flow path plate 2. Therefore, unnecessary oscillation is not communicated to the adjacent liquid chamber 21, so that mutual interference is prevented more thoroughly. The resin material forming the diaphragm part 41 is preferably a calendered film. Even if the calendered film becomes thin, substantially no defects such as pinholes are generated, thereby enhancing reliability of the diaphragm part 41. The material of the calendered film is preferably PPS (polyphenylene sulfide). PPS has particularly strong mechanical strength, low temperature dependence, and extremely strong resistance to solvents such that it is insoluble in any kind of solvent under 200° C. The thickness of the calendered film is preferably less than or equal to 9 μm, including the bonding layer. In FIG. 6, a width B of the diaphragm part 41 in the short axial direction of the liquid chamber 21, between the island-shaped protruding part 42 and the frame-shaped thick part 43, is preferably between 15 μm and 25 μm.

Figure 12:
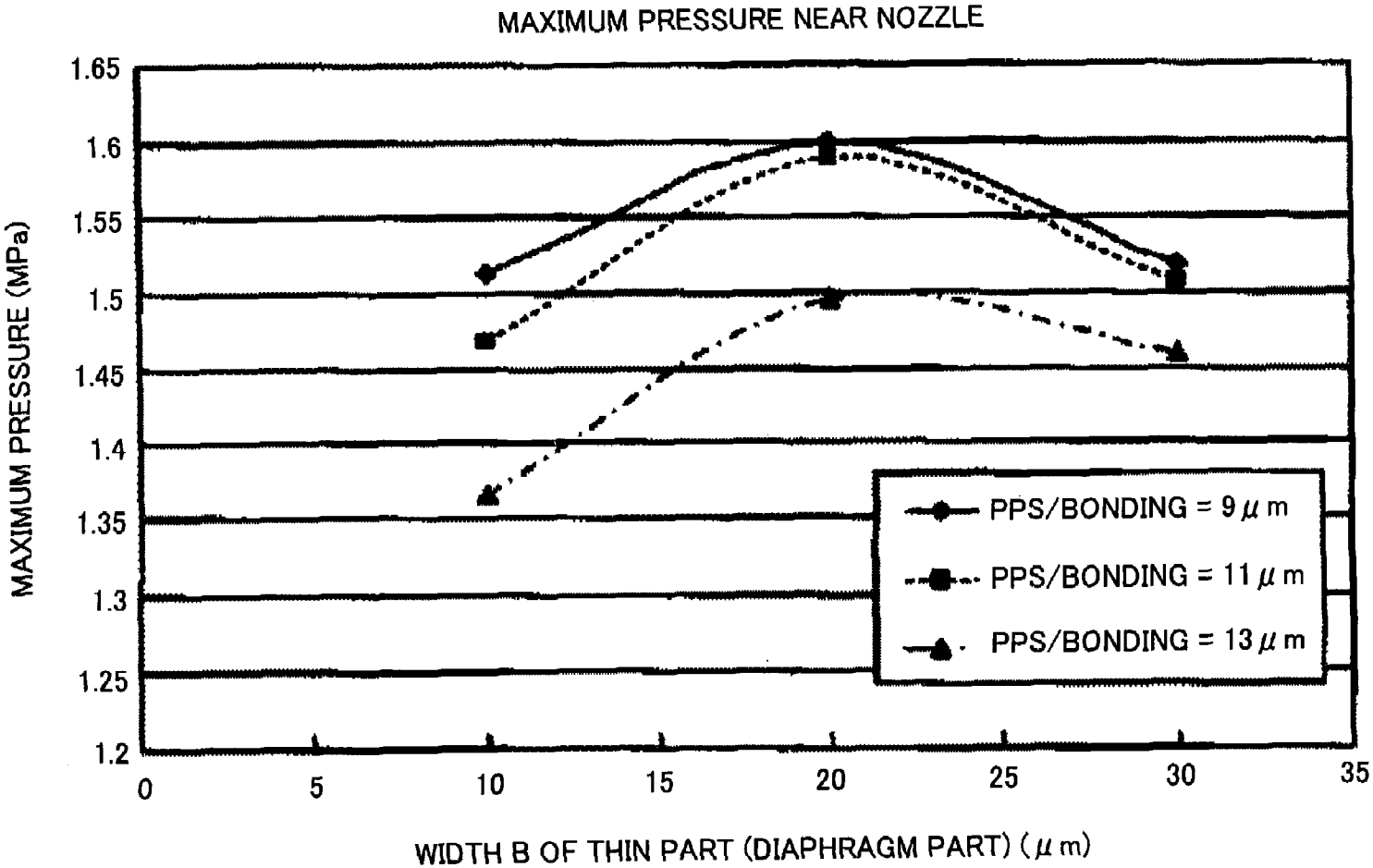
FIG. 12 is a graph indicating simulated changes in maximum pressure near a nozzle.
Figure 13:
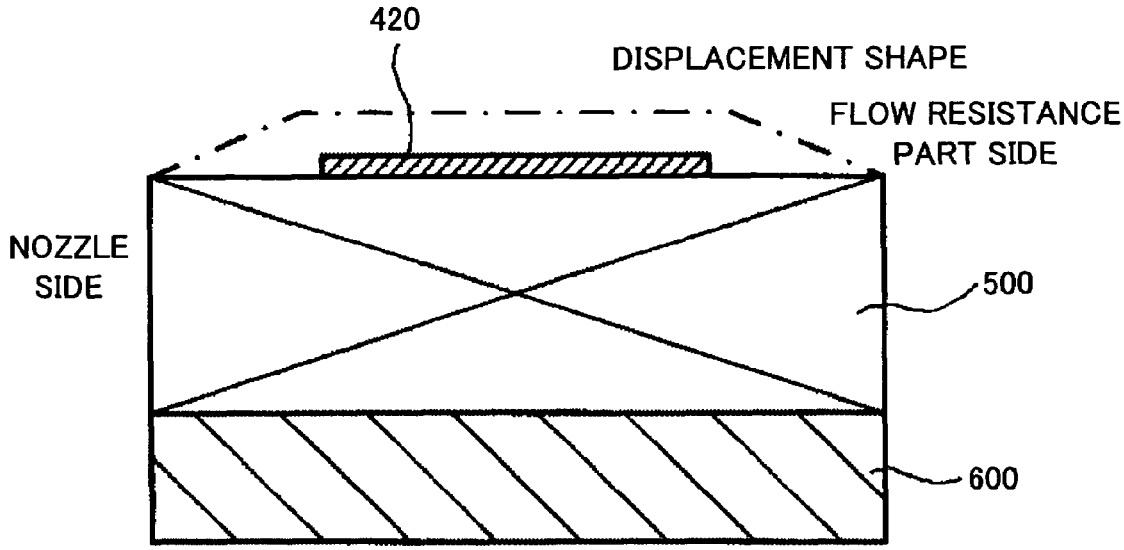
FIG. 13 is a schematic diagram for describing displacement of a driving unit of a conventional piezoelectric element.
Figure 14:
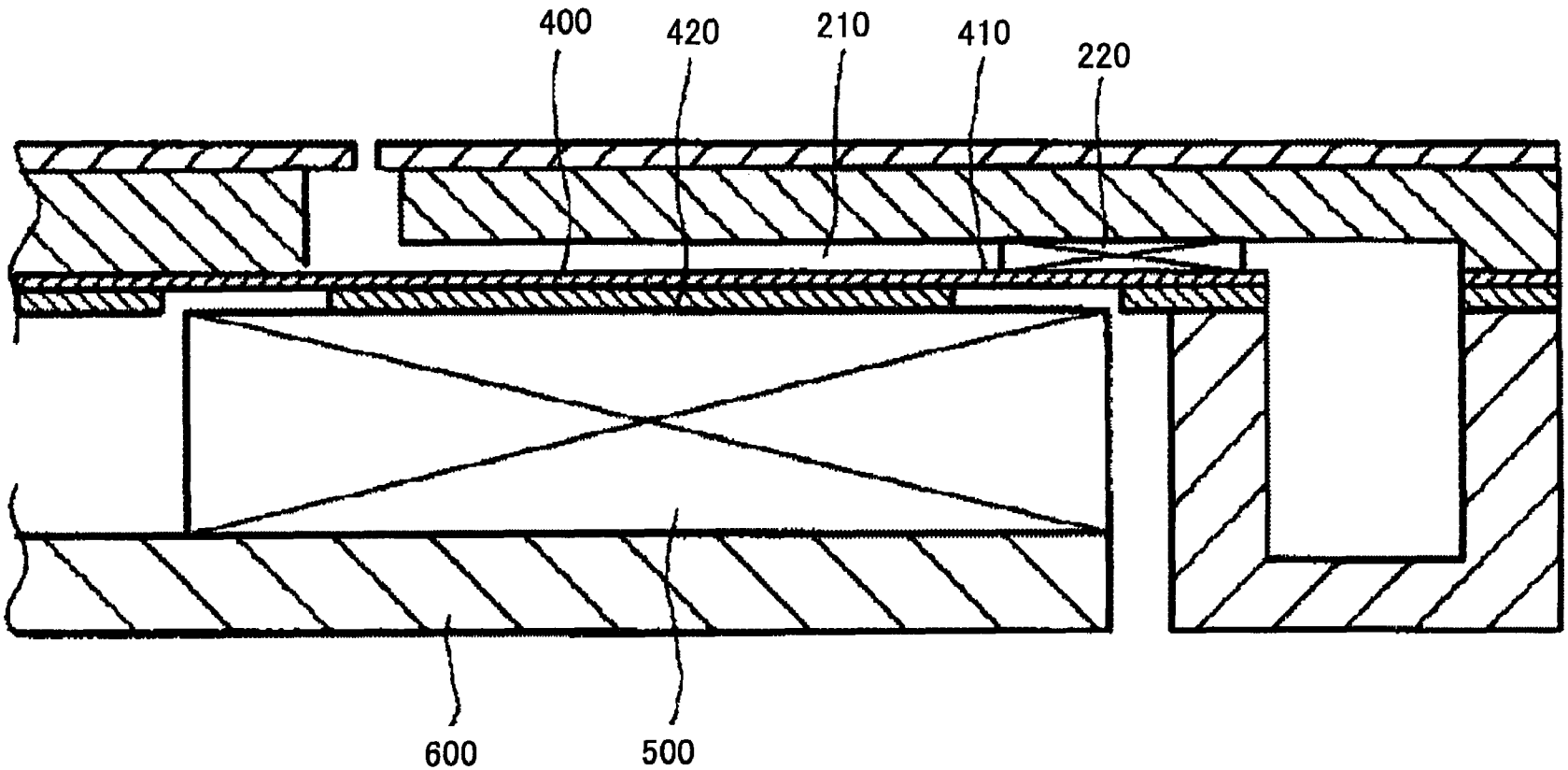
FIG. 14 is a partial cut-away view of a conventional recording head.

FIG. 12 is a graph indicating simulated changes in maximum pressure near the nozzle 31 obtained by changing the thickness of the calendered film made of PPS including the bonding layer, and the width B of the diaphragm part 41 in the short axial direction of the liquid chamber 21 between the island-shaped protruding part 42 and the frame-shaped thick part 43. As shown in FIG. 12, when the thickness of the calendered film made of PPS including the bonding layer exceeds 9 μm, rigidity of the oscillating plate 4 increases, which obstructs displacement of the piezoelectric element 5, such that the pressure near the nozzle 31 cannot be efficiently increased. Conversely, when the thickness of the calendered film made of PPS including the bonding layer is less than or equal to 9 μm, rigidity of the oscillating plate 4 is appropriate, so that displacement of the piezoelectric element 5 is not obstructed, and the pressure near the nozzle 31 is efficiently increased, thereby attaining preferable ejection properties. When the width B of the diaphragm part 41 is less than or equal to 15 μm, rigidity of the corresponding part increases, which obstructs displacement of the piezoelectric element 5. When the width B of the diaphragm part 41 is greater than or equal to 25 μm, rigidity of the corresponding part decreases, but the area of the diaphragm part 41 having low rigidity increases, such that the pressure near the nozzle 31 does not increase. When the width B of the diaphragm part 41 is between 15 μm and 25 μm, displacement of the piezoelectric element 5 is not obstructed, and the pressure near the nozzle 31 is efficiently increased, thereby attaining preferable ejection properties.

When the oscillating plate 4 includes the diaphragm part 41 made of the resin calendered film and the island-shaped protruding parts 42 and the frame-shaped thick parts 43 made of metal, plural oscillating plates 4 can be formed at once on a single sheet of laminated material. Each of the oscillating plates 4 is cut apart from the sheet of laminated material. Accordingly, the oscillating plate 4 can be fabricated efficiently.

In the above description, the recording head 1 is employed in the image forming apparatus 100 such as a printer, a facsimile machine, or a copier. However, the recording head 1 can be applied as a liquid droplet discharging head or a liquid droplet discharging device for discharging liquid other than ink, such as a DNA sample or resist pattern material.

According to one embodiment of the present invention, a pressure generating unit causes a liquid chamber to be largely displaced near a liquid supplying path, and therefore, preferable ejecting properties can be achieved.

Further, according to one embodiment of the present invention, pressure can be efficiently communicated.

Further, according to one embodiment of the present invention, a liquid droplet discharging device can be easily fabricated.

Further, according to one embodiment of the present invention, pressure can be steadily and efficiently communicated from the pressure generating unit to the liquid chamber.

Further, according to one embodiment of the present invention, the pressure generating unit can steadily cause a protruding part to be largely displaced without being obstructed by a thick part.

Further, according to one embodiment of the present invention, efficiency of displacement caused by the pressure generating unit can be enhanced, and unnecessary impacts of oscillation can be removed.

Further, according to one embodiment of the present invention, reliability of an oscillating plate can be enhanced.

Further, according to one embodiment of the present invention, liquid droplets can be discharged with preferable ejecting properties, and high-quality images can be steadily formed.

The present invention is not limited to the specifically disclosed embodiment, and variations and modifications may be made without departing from the scope of the present invention.

The present application is based on Japanese Priority Patent Application No. 2005-347658, filed on Dec. 1, 2005, the entire contents of which are hereby incorporated by reference.

What is claimed is:

1. A liquid droplet discharging device comprising:

a nozzle plate including a nozzle configured to discharge a liquid droplet;

a liquid chamber corresponding to the nozzle;

a liquid supplying path configured to supply liquid to the liquid chamber;

an oscillating plate having a first portion racing the liquid chamber and a second portion facing the liquid supplying path; and a pressure generating unit configured to apply pressure to the liquid in the liquid chamber by causing the oscillating plate to be displaced, the pressure generating unit being fixed to a fixing base;

wherein the pressure generating unit is longer than the liquid chamber in a longitudinal direction of the liquid chamber, wherein the liquid supplying path faces the oscillating plate, wherein the oscillating plate is formed of two layers including a thin layer, which is a diaphragm part, and a thick layer, which is an island-shaped protruding part, wherein the island-shape protruding part is configured on the thin layer, wherein the thin layer which faces the liquid supplying path, and the thick layer is configured on an opposite side of the thin layer, wherein the center of the pressure generating unit is out of line with the center of the island-shaped protruding part of the oscillating plate, and an edge of the pressure generating unit near the liquid supplying path is positioned not to face the second portion of the oscillating plate hut to face the first portion of the oscillating plate.

2. The liquid droplet discharging device according to claim 1, wherein the edge of the pressure generating unit near the liquid supplying path protrudes from an edge of the fixing base by a predetermined length.

3. The liquid droplet discharging device according to claim 1, wherein the pressure generating unit is a piezoelectric element, and the pressure generating unit causes the oscillating plate to be displaced in a d33 direction being a longitudinal oscillation mode.

4. The liquid droplet discharging device according to claim 1, wherein the oscillating plate includes a film, and a protruding part formed on the film, like protruding part being shorter than the liquid chamber, and the oscillating plate is bonded to the pressure generating unit via the protruding part.

5. The liquid droplet discharging device according to claim 4, wherein the oscillating plate includes a thick part surrounding the protruding part, and an edge of the protruding part in a longitudinal direction thereof near the liquid supplying path is connected to the thick part.

6. The liquid droplet discharging device according to claim 5, wherein the film is made of resin, and the protruding part and the thick part are made of metal.

7. The liquid droplet discharging device according to claim 6, wherein the film made of resin is a calendered film.

8. An image forming apparatus comprising the liquid droplet discharging device according to claim 1, wherein the image forming apparatus is configured to form an image using the liquid droplet discharged from the nozzle of the liquid droplet discharging device.

9. A liquid droplet discharging device comprising:

a nozzle plate including a nozzle configured to discharge a liquid droplet;

a liquid chamber corresponding to the nozzle;

a liquid supplying path configured to supply liquid to the liquid chamber;

an oscillating plate having a first portion facing the liquid chamber and a second portion facing the liquid supplying path; and a pressure generating unit configured to apply pressure to the liquid in the liquid chamber by causing the oscillating plate to be displaced, the pressure generating unit being fixed to a fixing base, the pressure generating unit being longer than the liquid chamber in a longitudinal direction of the liquid chamber, wherein the oscillating plate is formed of two layers including a thin layer, which is a diaphragm part, and a thick layer, which is an island-shaped protruding part, and the center of the pressure generating unit is out of line with the center of the island-shaped protruding part of the oscillating plate, and wherein an edge of the pressure generating unit near the liquid supplying path is positioned not to face the second portion of the oscillating plate but to face the first portion of the oscillating plate.

* * * * *